US006634069B2

(12) United States Patent
Dilo et al.

(10) Patent No.: US 6,634,069 B2
(45) Date of Patent: Oct. 21, 2003

(54) APPARATUS FOR FEEDING A FIBER FLEECE

(75) Inventors: Johann Philipp Dilo, Eberbach (DE); Eugen Gutsche, Fulda (DE)

(73) Assignee: Oskar Dilo Maschinenfabrik KG (DE)

( * ) Notice: Subject to any disclaimer, the term of this patent is extended or adjusted under 35 U.S.C. 154(b) by 0 days.

(21) Appl. No.: 10/253,980

(22) Filed: Sep. 24, 2002

(65) Prior Publication Data

US 2003/0056348 A1 Mar. 27, 2003

(30) Foreign Application Priority Data

Sep. 24, 2001 (DE) ..... 101 46 907

(51) Int. Cl.[7] ..... D04H 18/00

(52) U.S. Cl. ..... 28/107; 28/112; 28/116; 26/18.6

(58) Field of Search ..... 28/107, 112, 116, 28/111, 114, 134, 135, 136, 137, 138, 122, 166; 26/18.6, 18.5; 271/264, 272, 275, 198, 8.1, 7

(56) References Cited

U.S. PATENT DOCUMENTS 1,454,049 A * 5/1923 Genung ..... 28/107
2,177,604 A * 10/1939 Stone ..... 28/107
3,540,096 A * 11/1970 Porta ..... 28/110
3,621,540 A * 11/1971 Morrill ..... 28/107
3,837,054 A * 9/1974 Fehrer ..... 28/107
3,921,266 A * 11/1975 Fehrer ..... 28/107
4,237,180 A * 12/1980 Jaskowski ..... 28/112
5,307,546 A * 5/1994 Dilo ..... 28/107
5,371,928 A * 12/1994 Dilo ..... 28/107
5,671,518 A * 9/1997 Kummermehr et al. ..... 28/112
6,385,825 B1 * 5/2002 Wang et al. ..... 28/107

* cited by examiner

*Primary Examiner*—Amy B. Vanatta
(74) *Attorney, Agent, or Firm*—Jansson, Shupe & Munger, Ltd.

(57) ABSTRACT

In an apparatus for feeding a fiber fleece web to a needling machine, a compacting means is arranged between a pre-compressor and a supply roller pair, said compacting means having rollers provided with teeth at their circumference. These rollers compress the fiber fleece and effect a partial re-orientation of the fibers from the horizontal into the vertical, which contributes to substantially maintaining the compacting of the fiber fleece. The compacting means may together with the supply roller pair form a drawing zone for the fiber fleece web. The compacting means preferably includes at least one roller triple that consists of two lower rollers arranged at a low mutual distance in juxtaposition, and upper rollers bridging over the gusset between the lower rollers. The rollers of the roller triple are provided on their periphery with all-steel armaments, and the supply rollers are preferably also provided with all-steel armaments and have higher speeds of rotation than the rollers of the roller triple. In an alternative embodiment, the means comprises at least one roller provided with all-steel armaments an a trough opposing the roller, said trough forming with the roller a gap narrowing in the direction of rotation of the roller. In this gap, the fiber fleece web passed between the roller and the dent is clamped. The discharge end of the gap opposes the supply roller pair, which is preferably driven at a high speed of rotation than said roller that opposes the trough.

20 Claims, 8 Drawing Sheets

APPARATUS FOR FEEDING A FIBER FLEECE

FIELD OF THE INVENTION

The present invention refers to apparatus for feeding a fiber fleece web to a needling zone of a needling machine and, more particularly, to apparatus of the type comprising a pre-compressor with a lower endless moving belt and an upper endless moving pre-compression belt which is arranged above the lower belt and which forms therewith a gap narrowing in a transport direction of a fiber fleece web to be supplied therethrough, and a supply roller pair arranged in front of the needling zone of the needling machine, said supply roller pair consisting of an upper and a lower supply roller, which form a gap between them and which are provided with non-rotating guide fingers, which each bridge over an upper and a lower gusset gap between the supply rollers and a holding-down member or needle plat of the needling machine.

STATE OF THE ART

An apparatus of this kind is common in needling installations and is known from U.S. Pat. No. 5,307,546.

The purpose of the pre-compressor of the apparatus is to reduce the thickness of a fiber fleece web of a loose but very thick structure, i.e. an un-needled fleece web supplied by a fleece laying device, to such an extent that it can be guided into the gap between two positively driven supply rollers supplying the fleece web to a needling machine.

The pre-compressor merely compresses the un-needled fleece web. Depending on the resiliency of the fiber material forming the fleece web, the un-needled fleece web recovers when it leaves the gap between the lower belt and the pre-compression belt arranged above the lower belt. This can lead to difficulties when the fleece web enters the needling machine arranged downstream.

SUMMARY OF THE INVENTION

It is therefore the object of the invention to provide an apparatus as set forth above, which enables easy feeding of an un-needled fiber fleece web to a needling machine even if the fibers comprised in the fiber fleece web develop high recovery forces due to their resiliency.

This object is solved by an apparatus of the type referred to above which also comprises a compacting means (device) including at least two compacting rollers forming a gap between one another, said compacting means being arranged between the pre-compressor and the supply roller pair, at least one of the rollers of said compacting means being provided at its periphery with toothed all-steel armaments or being formed as a disk roller having a plurality of toothed disks, the fiber fleece web being fed through the rollers of said compacting means.

The invention supplements a known fleece supply arrangement comprising a pre-compressor and supply roller by a compacting means inserted therebetween which does not only compress the fiber fleece but which also partially re-orientates the fibers therein. It presses fibers perpendicularly to their position in the un-needled fleece into the fleece, similar to a needling process. By the frictional forces and by mutual irritation, the fibers pressed into the fleece keep the fleece in compressed state, so that it cannot recover so easily, as the fleece that was compressed without its fiber structure having been changed be re-orientation of the fibers.

Moreover, the invention enables an especially advantageous utilization of the compacting means for a further purpose that will be described further below.

In a fiber fleece or un-needled fleece web the fibers usually have an orientation extending transversely to the longitudinal extension of the web, said orientation being provided to them by a laying process performed by a fleece laying apparatus. Such a preferred direction of the fiber orientation in the needle fleece manufactured therefrom leads to the consequence that the product, e.g., a felt, has different drawing properties in the different drawing directions, i.e. it reacts differently when being drawn depending on the direction. For instance, its strength transversely to the web direction (transverse strength) is greater than its longitudinal strength.

In order to avoid these properties that are generally disadvantageous, the un-needled fleece web is usually only pre-needled in a first needling step, subsequently subjected to a drawing process in the longitudinal direction to re-orientate the fibers transversely to their prevailing direction that extends transversely to the web direction, and is needled another time in a second needling process. This drawing in the longitudinal direction of the pre-needled fleece web at the same time reduces its surface weight.

It is quite natural that the fibers are less movable in a needled fleece web pre-solidified by pre-needling than in a fully un-solidified un-needled fleece web. Thus, arrangements have been proposed in which a drawing equipment is arranged between a fleece laying apparatus and an intake region of a needling machine, in which the un-solidified un-needled fleece web is drawn. It has been proposed to provide such drawing equipment with a plurality of rollers provided with armaments, which is therefore very expensive. Moreover, it requires a lot of space.

According to an embodiment of the invention, the supply rollers upstream of the needling machine are provided with all-steel armaments, i.e. with a toothing at their circumference, and form an active part of a drawing equipment which further includes the above-mentioned compacting means. The fleece is held substantially positively in this compacting means so that in the case of differently adjusted speeds of rotation of the supply rollers and of the rollers of the compacting means arranged upstream thereof, the fleece web is drawn in the area between the rollers of the compacting means and the supply rollers of the needling machine. If the apparatus comprises a plurality of toothed rollers in the compacting means, a plurality of drawing zones can be realized at the rollers by differently adjusting a plurality of speeds of rotation.

At least one compacting roller pair or at least one compacting roller triple (i.e., with three compacting rollers rather than two) or at least one compacting roller with an opposing compression trough member may be arranged in the supply direction upstream the supply rollers. At least one of these rollers is provided with all-steel armaments on its circumference. The teeth of these armaments press into the un-needed fleece web and entrain fibers that they press into the un-needled fleece web so that a compression and at the same time a certain solidification of the un-needled fleece web is obtained, which counteracts a recovery of the un-needled fleece web after leaving the gaps between the rollers or between the roller and compression trough. Thereby, the guide fingers behind the supply rollers are relieved and the friction is reduced. The supply rollers advance the un-needled fleece web in compacted condition to the first needle row of the needling machine. Tensile forces acting on the fleece web in this part of the path, that would increase fleece mass fluctuations, do therefore not occur.

A press-on roller of a comparatively small diameter and a smooth surface may possibly be arranged between the supply rollers and the discharge side roller of a roller triple arranged upstream thereof, said press-on roller pressing the un-needled fleece web onto the discharge side roller of this roller triple and therefore serves for shortening the drawing zone between the roller triple and the supply rollers.

In the last mentioned portion, a so-called gusset roller of a small diameter in the gusset between the discharge side roller of the roller pair or roller triple of the compacting means and the lower supply roller of the needling machine adjoining same can be arranged, which substantially fills this gusset between the rollers. By means of the gusset roller a possible recovery of the fiber fleece web caused by the resiliency of the fibers is additionally counter-acted.

In the fleece feeding system of the invention according to the embodiment explained, the supply rollers have a double function. On the one hand they participate in the drawing of the un-needled fleece web and on the other hand they determine the supply of the un-needled fleece web in the needling machine. The overall arrangement does not only effect a compression of the un-needled fleece web but also a drawing of same and possibly a solidification and therefore has also at least a double function if not even a triple function. Thus, a significant reduction of the apparatus expenditure and the space requirements can be achieved by the invention.

Conventional carding rollers may be used as rollers having armaments. Furthermore, it must be noted that toothed rollers can also be used instead of rollers provided with all-steel armaments, i.e. rollers that consist of a plurality of toothed disks. The teeth may be provided with notches that point towards the free tooth end (i.e., the distal end of the tooth) and favorably entrain the fibers when pressing into the fiber fleece web and press the fibers into the fleece. The tooth disks may have a mutual distance (i.e., may be spaced) so that it is possible to arrange the rollers of a pair in a manner that the disks of one of the rollers are directed towards the gaps between the rollers of the respective opposing roller. The distance between the rollers can thus be minimized.

The invention will now be explained with reference to the drawings.

SHORT DESCRIPTION OF THE DRAWINGS

DETAILED DESCRIPTION OF PREFERRED EMBODIMENTS

Figure 1:
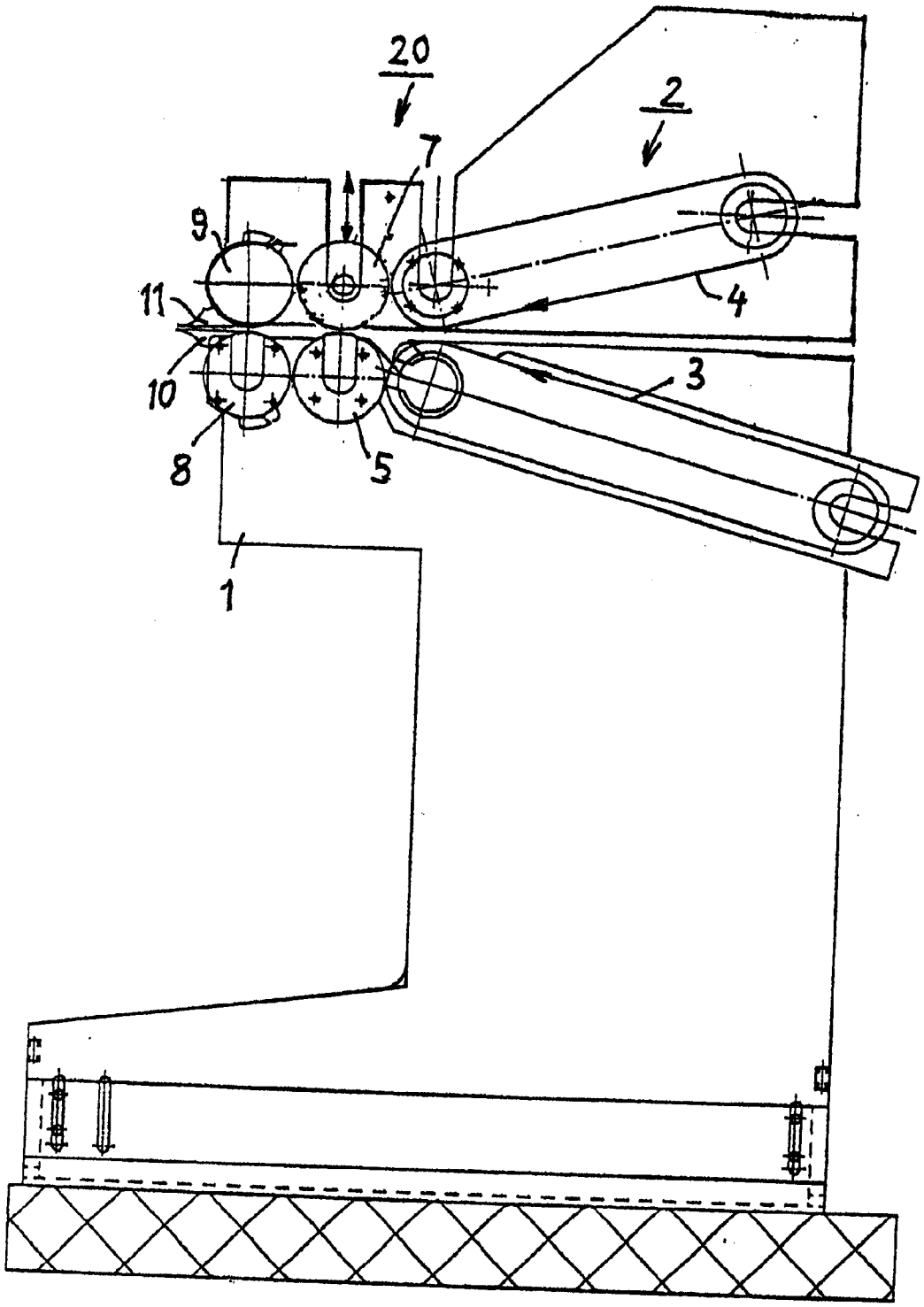
FIG. 1 shows a schematic view of an apparatus according to the invention with a roller pair between a pre-compressor and a supply roller pair of a needling machine (not shown).

The apparatus according to FIG. 1 comprises a frame 1, in which a pre-compressor 2 formed by a lower, endless conveyor belt 3 and an upper, endless pre-compression belt 4 arranged above the lower belt 3 is supported. The lower belt 3 and the upper pre-compression belt 4 are forming a gap narrowing in a transport direction of the pre-compressor 2. The transport direction of the belts 3 and 4 is indicated in the drawing by arrows.

A compacting device designated by 20 is arranged downstream of the pre-compressor 2 in the frame 1, said compacting means comprising a roller pair of a lower compacting roller 5 and an upper compacting roller 7 each rotatably supported by the frame 1. The rollers 5 and 7 are driven by means of a motor, and the distance between the two rollers 5 and 7 is adjustable, which is indicated by a double arrow on the upper roller 7,in order to be able to cope with different thicknesses of the un-needled fleece web supplied thereto. The roller 7 may preferably be lifted off the overall arrangement, e.g., for maintenance purposes.

The rollers 5 and 7 are each provided with all-steel armaments on their circumference, said armaments consisting of a wire provided with a toothing, said wire being wound onto the roller periphery. Rollers of this type are known as carding rollers.

On the discharge side of the roller pair 5 and 7 a supply roller pair is rotatably supported, said roller pair comprising of a lower supply roller 8 and an upper supply roller 9. The bearings of the supply rollers 8 and 9 are usually held in the machine frame of an associated needling machine (not shown), but the supply rollers 8 and 9 may, as shown in FIG. 1, also be supported in the separate frame 1 of the feeding apparatus.

Figure 3:
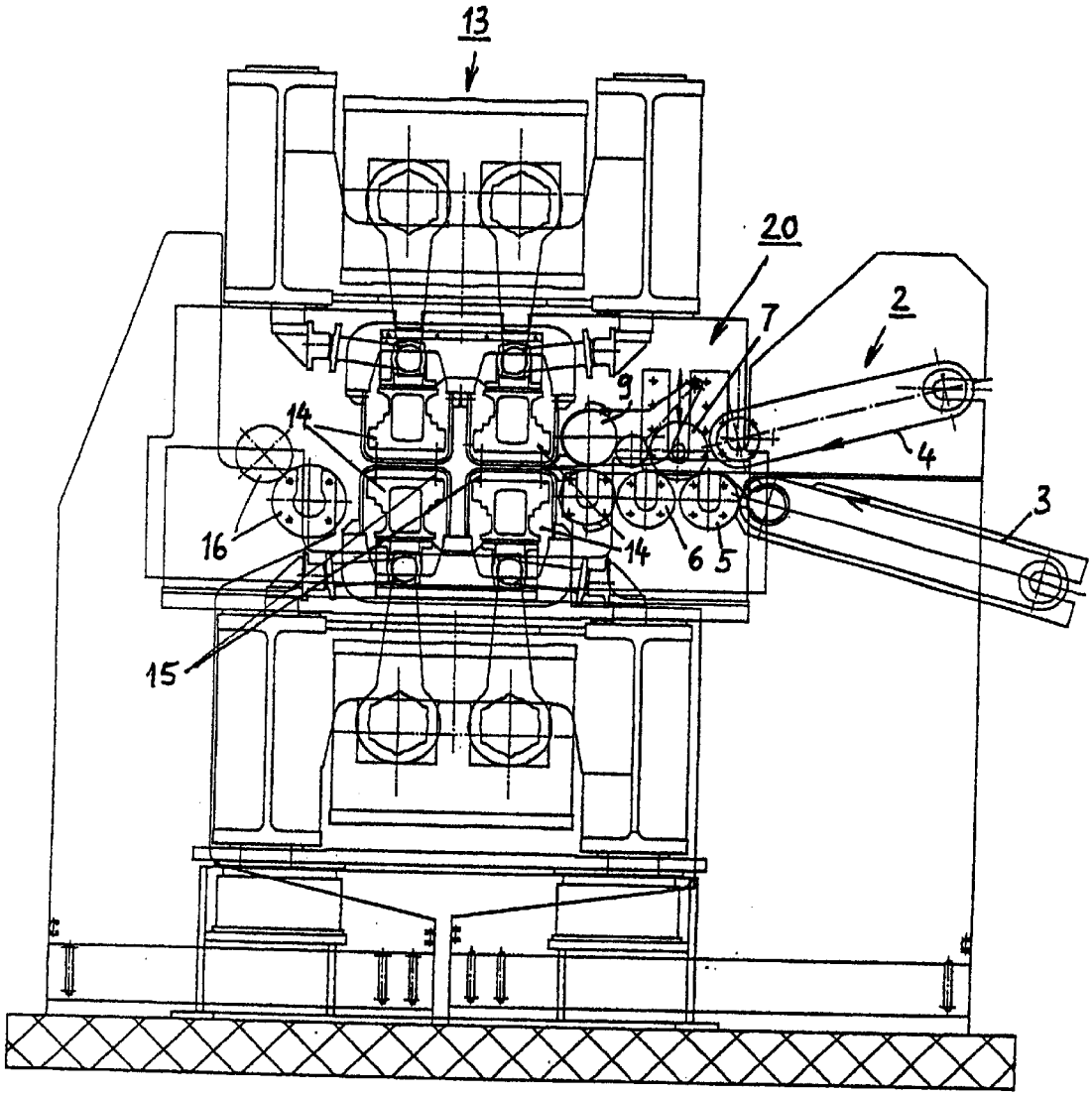
FIG. 3 shows a schematic side view of a needling machine in combination with an apparatus according to FIG. 2.

The supply rollers 8 and 9 are driven by a motor and are so-called finger rollers, as they are segmented in the axial direction, wherein non-rotating guide fingers 10 and 11 are arranged between the segments, and guide fingers 10 and 11 extending in the feed direction of the un-needled fleece web (not shown) to conduct the un-needled fleece web discharged by the supply rollers 8 and 9 into the needling zone of a following needling machine, not shown in FIG. 1 (see in this respect FIG. 3).

Figure 2:
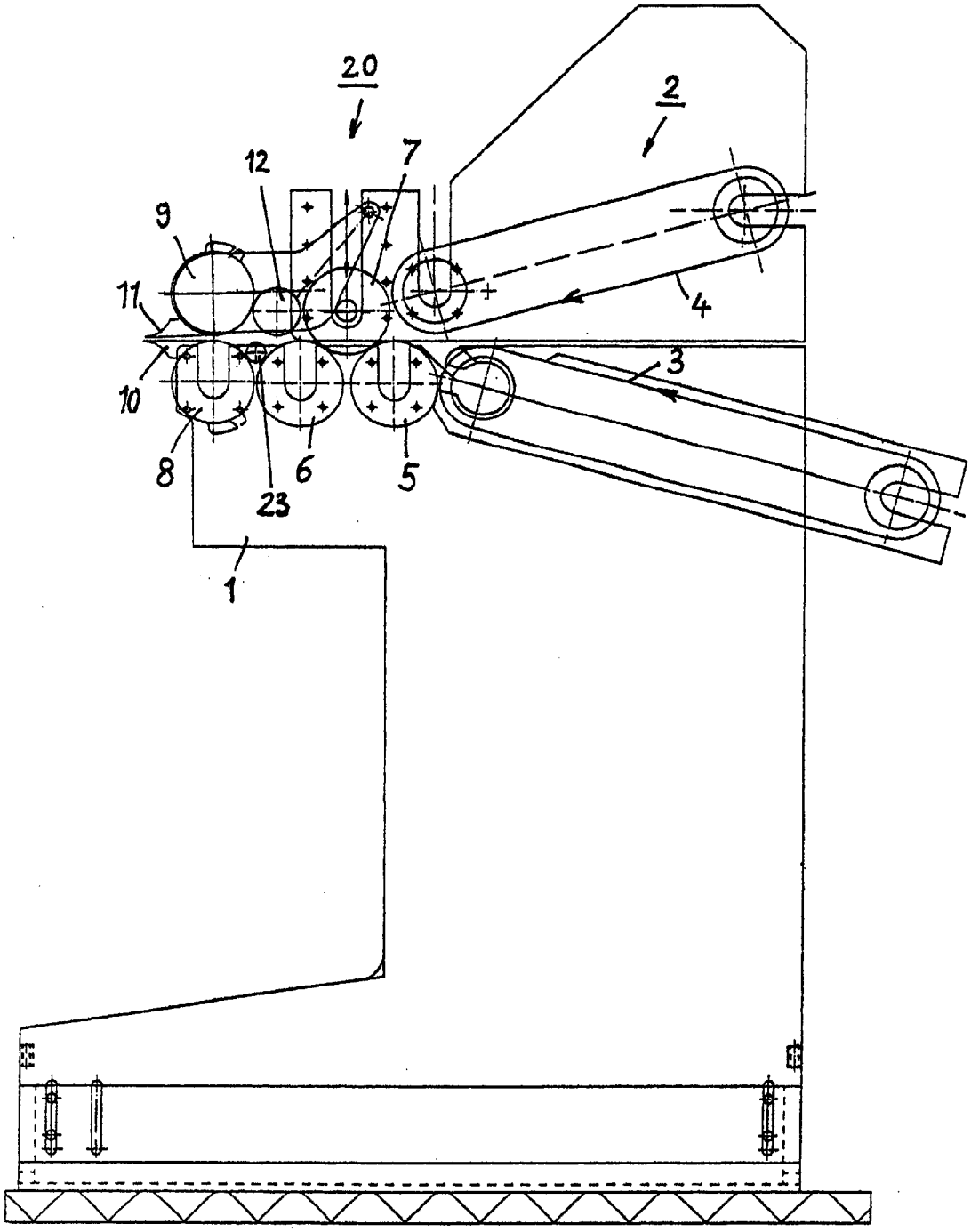
FIG. 2 shows a schematic side view of an apparatus according to the invention with a roller triple between a pre-compressor and a supply roller pair.

According to FIG. 2, instead of the roller pair 5 and 7 a roller triple may be arranged between the pre-compressor 2 and the supply roller pair 8, 9, and supply roller triple consisting of lower compacting rollers 5 and 6 and of an upper compacting roller 7, which are rotatably arranged in the frame 1 and which are driven by a motor. The lower rollers 5 and 6 are arranged at a narrow mutual distance and they are opposed by the common upper roller 7, whose distance to the lower rollers 5 and 6 can be adjusted. At least one of these rollers, but preferably all rollers, are provided on their circumference with all-steel armaments. The gap between the upper roller 7 of the roller triple and the upper supply roller 9 may be filled by a small roller 12 (sometimes referred to herein as a "filler" roller) which acts as a press-on roller.

Moreover, a so-called gusset roller 23 of a small diameter may be arranged additionally, as shown in FIG. 2, in the gusset between the discharge side roller 6 of the roller triple 20 and the supply roller 8 of the needling machine, and said gusset roller substantially filling said gusset and counteracting a recovery of the fiber fleece web that could be caused by the resiliency of its fibers. Such a gusset roller can be used at places where the gusset shall be bridged over between the rollers, i.e. particularly in the embodiment according to FIG. 1.

As shown in the above-described figures, the rollers of the compacting means between the pre-compressor and the supply roller pair are arranged on the same level. Thus, the compacting means can easily be integrated into existing systems in which the pre-compressor and the supply rollers already exist and are adapted with respect to each other.

FIG. 3 shows a complete arrangement of a needling machine designated by 13 and the feeding apparatus shown in FIG. 2. A repetition of the explanation of the feeding apparatus is therefore void. The needling machine 13 is a double needling machine in the example shown, i.e. it is a machine in which in each needling zone the un-needled fleece web is needled from top and from below. The needling machine in the example shown has two needle bar pairs 13 which are coupled to each other and which are set in up and down swinging motion by two eccentric means via associated connecting rods. The needle bars 14 carry needle boards that are equipped with a plurality of needles 15. On the discharge side of the needle zone determined by the needle bars 14 a pair of actively driven discharge rollers 16 is located, which draw the fleece web needled in the needling zone out of the machine.

It can be seen from a comparison of the structures shown in FIGS. 1 and 2 that the feeding apparatus of the invention is a special unit that can be used with the needling machine 13, and which can for instance be replaced by a differently designed unit, if the features of the invention shall not be used.

During operation of the arrangements shown in the drawings, a cross-laid fiber fleece or un-needled fleece web (not shown) coming from a cross layer (not shown) is supplied to the pre-compressor 2, where the un-needled fleece web is pre-compressed. From there the un-needled fleece web is supplied to the roller pair 5, 6 or the roller triple 5–7. When passing this roller pair or roller triple, the teeth that are formed on the all-steel armaments (or tooth disks) of at least one of the rollers press into the compacted un-needled fleece web and solidify same due to the pressing-in of fibers that are entrained by the teeth. The un-needled fleece web running out of the roller pair or triple then reaches the supply rollers 8 and 9 and is drawn through the gap formed between these rollers. The un-needled fleece web reaches between the guide fingers 10 and 11, which prevent a recovery of the un-needled fleece web, which, even in very reduced scope, can still exist, and from there to the needling zone of the successively arranged needling machine 13 where the un-needled fleece web is needled from both sides.

In the roller triple according to FIG. 2 the lower rollers 5 and 6 are arranged at a narrow mutual distance. They are driven actively, i.e. by means of a motor, and on their periphery they carry all-steel armaments. They are opposed by the common upper roller 7 whose distance to the lower rollers 5 and 6 may be adjustable. The upper roller 7 comprises on its periphery preferably all-steel armaments and is driven positively. Instead of the all-steel armaments the upper roller may also have a smooth surface, as will be described later on.

The distance between the lower rollers 5 and 6 on the one hand and the upper roller 7 is adjustable to be able to take different web thicknesses (fleece masses) of the un-needled fleece into account and to safely achieve that the fleece web (not shown in the drawing) is clamped between the upper roller 7 and the lower rollers 5 and 6.

According to a preferred embodiment of the invention, the rollers 5 and 7 of the roller pair or the rollers 5–7 of the roller triple and the supply rollers 8 and 9 are driven in a manner that the speeds of rotation of the rollers 5 and/to 7 and the supply rollers 8 and 9 are different to one another, wherein the supply rollers 8 and 9 have a higher circumferential speed than the rollers of the roller pair or roller triple preceding them. In this manner the fleece web clamped by the rollers 5 and 7 or 5–7 and by the supply rollers 8 and 9 is drawn during operation in the region between the roller pair 5, 7 and the discharge side roller 6 of the roller triple on the one hand and the supply rollers 8 and 9 on the other hand.

Additionally, the discharge side roller 6 of the roller triple may be driven at a higher circumferential speed than the intake side roller 5 of this roller triple so that, in case the opposing upper roller 7 has a smooth surface, a drawing zone is also formed between the rollers 5 and 6 in which the un-needled fleece web is drawn in the longitudinal direction.

As shown in the drawing, a press-on filler roller 12 of a comparatively small diameter may be arranged between the discharge side roller 6 of the roller triple and the supply rollers 8 and 9. This press-on filler roller closes the gusset gap between the roller triple and the supply roller pair and prevents in this area a recovery of the un-needled fleece web. This press-on filler roller 12 has a preferably smooth surface and may be pressed against the discharge side lower roller 6 of the roller triple.

It can be recognized from a comparison of the structures shown in FIG. 13 that the feeding apparatus of the invention is a separate unit supplementing the needling machine 13, which can possibly also be replaced by a differently designed unit.

Figure 4:
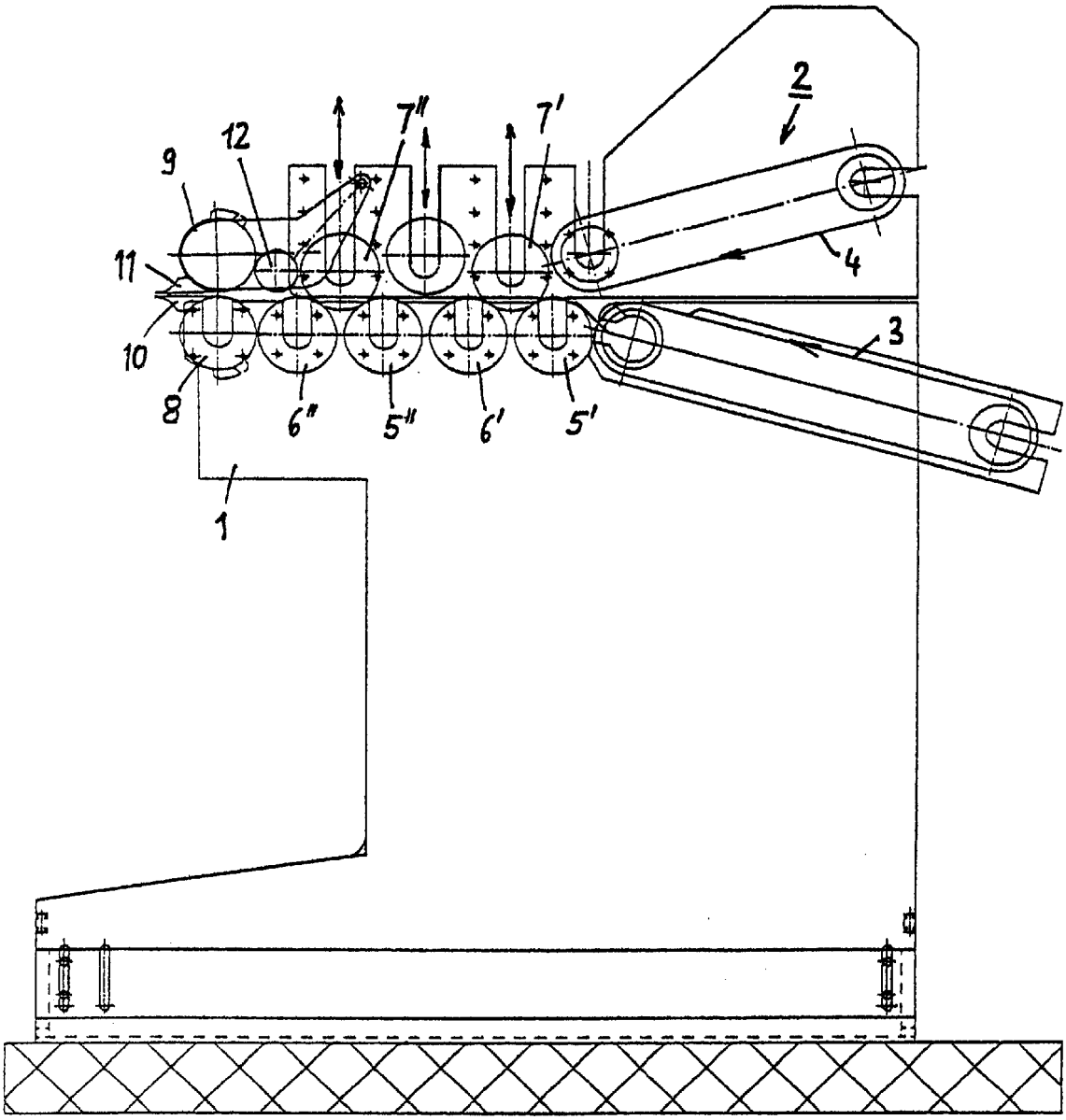
FIG. 4 shows a schematic side view of a feeding apparatus according to the invention with two roller triples between a pre-compressor and a supply roller pair.
Figure 5:
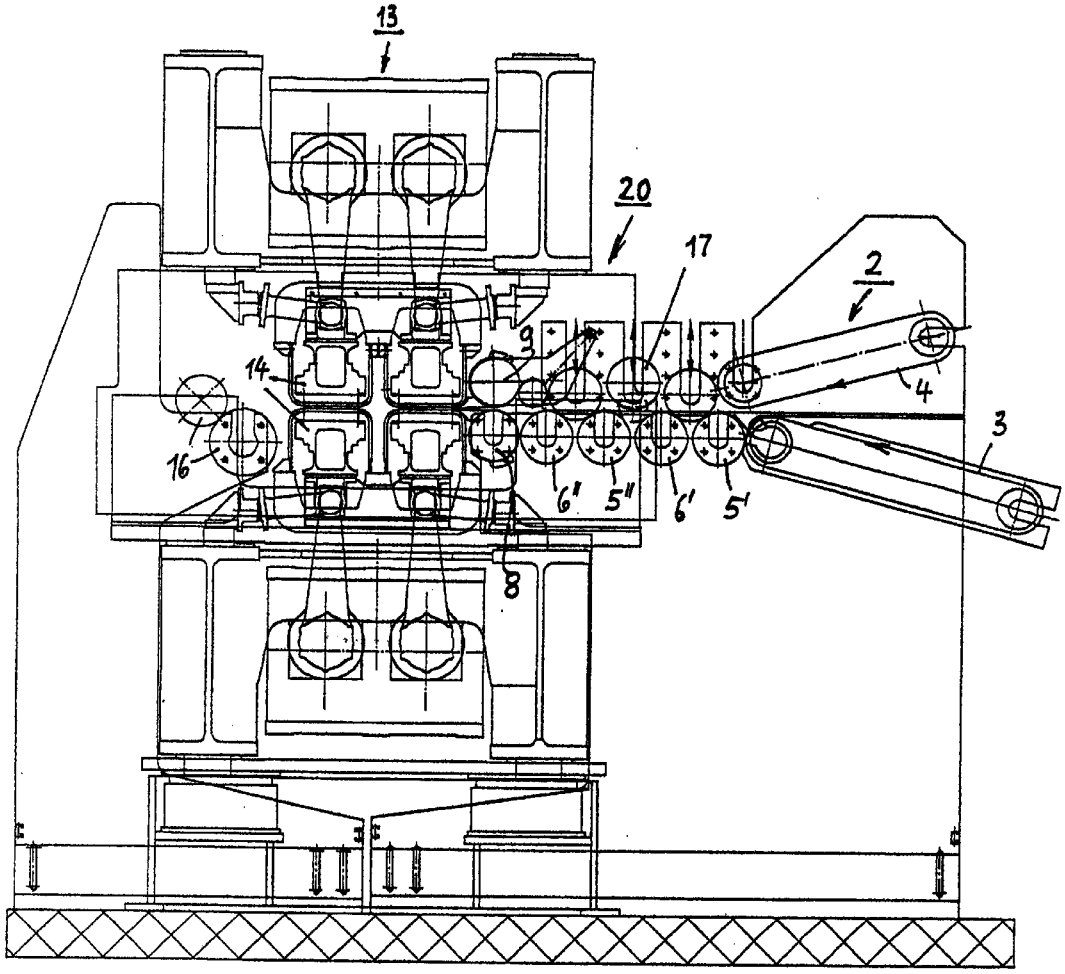
FIG. 5 shows a schematic side view of a needling machine in combination with a feeding apparatus according to FIG. 4.

As an example, FIGS. 4 and 5 show a feeding apparatus according to the invention, which is equipped with two roller triples. The rollers of the first roller triple carry reference numerals 5', 6' and 7', wherein the rollers of the second roller triple carry reference numerals 5", 6" and 7".

Between the discharge side lower roller 6' of the first roller triple and the intake side roller 5" of the second roller triple, a press-on roller 17 (sometimes referred to herein as an "intervening" roller) is arranged on a level above them. The level may be adjusted in a manner as shown by a double arrow in this roller. This press-on intervening roller has a smooth surface and shall on the one hand press the un-needled fleece web onto the surfaces of the lower rollers 6' and 5", and on the other hand it shall allow a drawing of the un-needled fleece web in the region between the first roller triple and the second roller triple when these triples are driven with stacked circumferential speeds increasing in the transport direction of the un-needled fleece web.

Moreover, the structure corresponds to the structure of FIG. 2, which also applies in combination of this feeding apparatus with a needling machine, which is shown in FIG. 5 and which does not have to be explained again.

In the embodiment shown in FIGS. 4 and 5, a further roller triple is arranged between the roller triple connected to the pre-compressor 2 and the supply rollers 8 and 9. The circumferential speed of the rollers is greater than that of the rollers of the first roller triple. Thus, in this embodiment, the un-needled fleece web existing from the first roller triple 5', 6', 7' is drawn in the region below the press-on roller 16, and after passing through the second roller triple formed by the rollers 5", 6" and 7" is drawn in the region between this roller triple and the supply rollers 8 and 9 a second time.

The armaments of the rollers of the roller triple/s have a plurality of advantageous effects that are also revealed on the fleece: The fleece is solidified by the teeth of the armaments, since they grip fibers and press them through the fleece. Furthermore, the un-needled fleece web is held by the rollers of the roller triple so that it can be drawn between the roller triples and discharge side thereto. This leads to a partial re-orientation of the fibers of the un-needled fleece web. The solidification has the advantage that the un-needled fleece web after leaving the roller gaps does no longer recover. The drawing has the advantage that a re-orientation of fibers is carried out before the first needling process, i.e. in a state in which the cross-laid fibers are very freely movable. Even if the teeth of the supply device lead to a certain solidification on the un-needled fleece according to the type of needles in the manner described, this is not comparable with a "real" needling state caused by needles.

Figure 6:
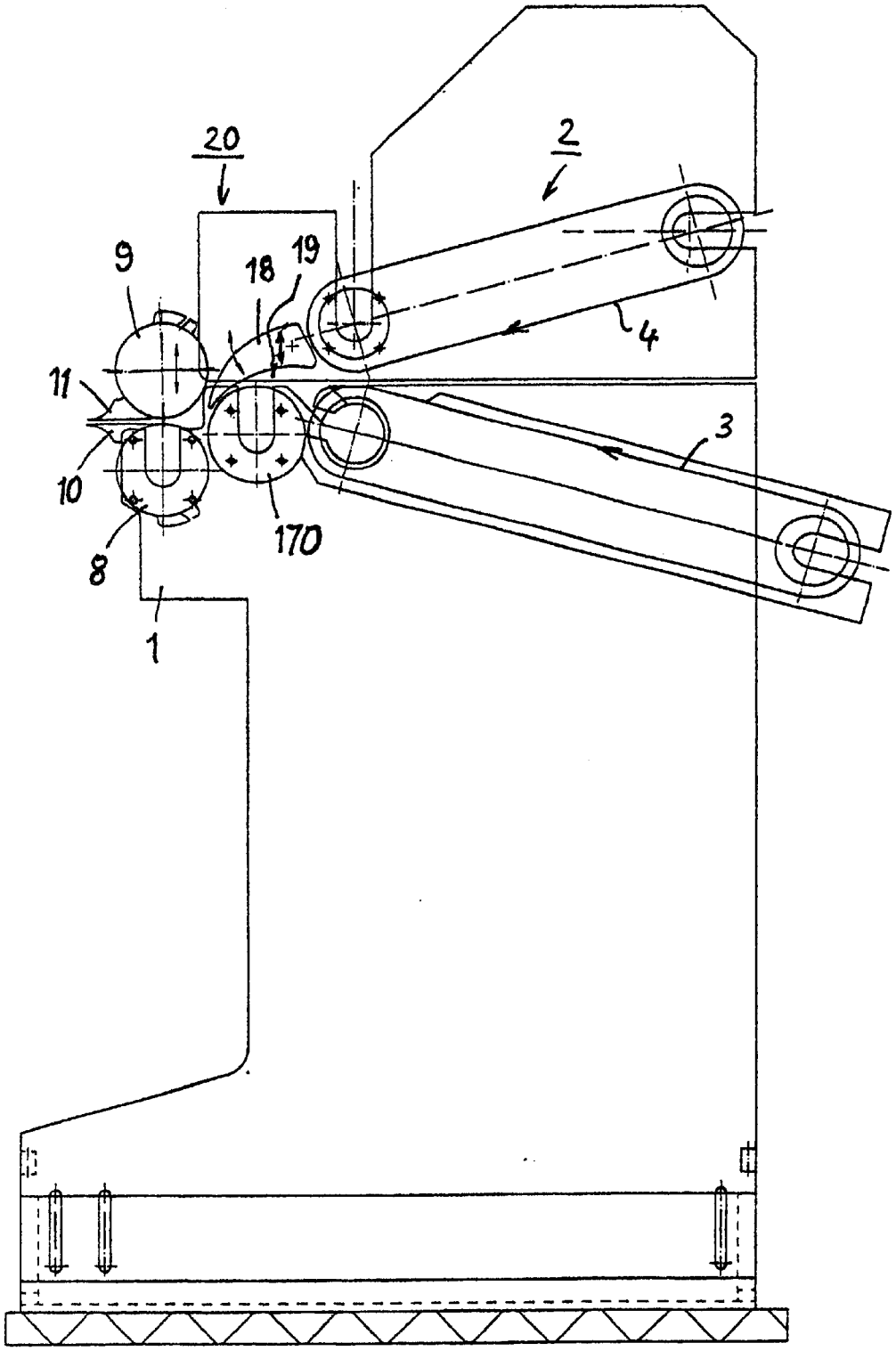
FIG. 6 shows a schematic side view of an alternative embodiment of the invention comprising a roller/trough combination instead of a roller triple.

FIG. 6 shows an embodiment of the invention that is based on an alternative solution. In this embodiment the roller pair of FIG. 1 is replaced by a roller 170 provided with all-steel armaments and an opposing trough 18 which together with the roller forms a gap 19 constricting in the direction of rotation of the roller. The un-needled fleece web is clamped and in the gap when running through the device. The roller 170 is driven at a lower circumferential speed than the supply rollers 8 and 9 so that the un-needled fleece web after leaving the discharge side end of the gap 19 that opposes the supply roller pair 8, 9, is drawn in the longitudinal web direction. The distance of the trough 18 to the roller 170 and/or the angle of inclination of the trough 18 with respect to the roller 170 are purposefully adjustable to be able to take different thicknesses of the un-needled fleece web into account. This is symbolized in FIG. 6 by double arrows on the trough 18.

Figure 7:
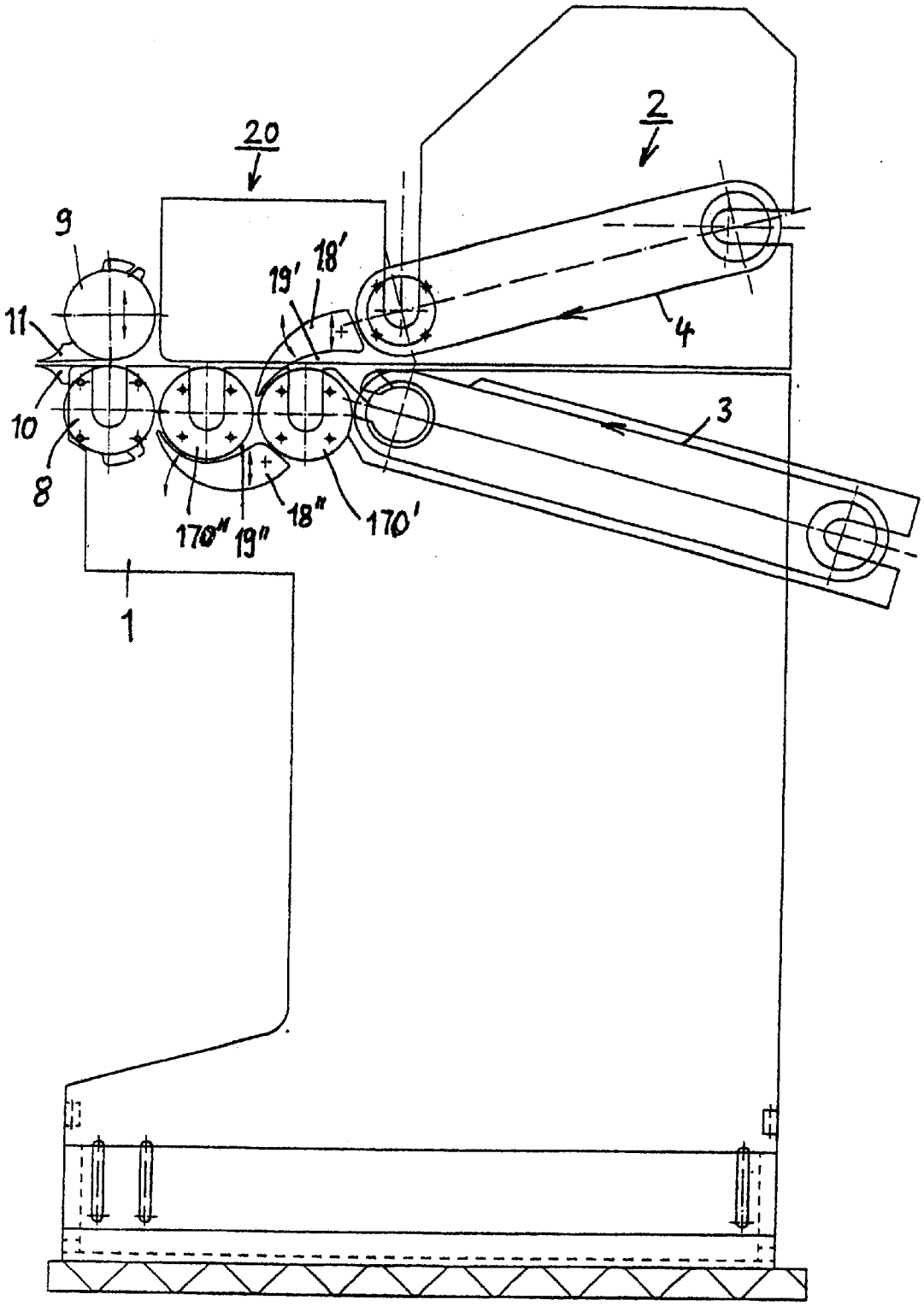
FIG. 7 shows a schematic side view similar to FIG. 5 with two roller/trough combinations arranged in series.

In the embodiment shown in FIG. 7, two roller/trough combinations of the type shown in FIG. 6 are arranged in succession in the fleece transport direction. The roller 170" has a higher circumferential speed of rotation than the roller 170' arranged upstream thereof Each roller is opposed by a trough, wherein the trough 18' is arranged above the roller 170' and the trough 18" is arranged below the associated roller 170". The un-needled fleece web (not shown) discharged by the gap 19' is received by the gap 19" between the trough 18" and the roller 170" and is clamped therein. In the region between the discharge side end of the gap 19" and the running onto the roller 170" the un-needled fleece web is drawn due to the different circumferential speeds of rotation of the rollers. The same takes place between the discharge side end of the gap 19" and the supply rollers.

The troughs 18' and 18" are preferably adjustable in distance to their associated rollers 170' and 170" and in their position with respect to the roller circumference around the axes of rotation of the rollers and in inclination with respect to the roller surfaces. In this manner it is possible to adjust the drawing lengths in the drawing zones and to take different staple length of the fibers contained in the un-needled fleece web into consideration. Some of these adjustment possibilities are symbolized by double arrows on the troughs.

Figure 8:
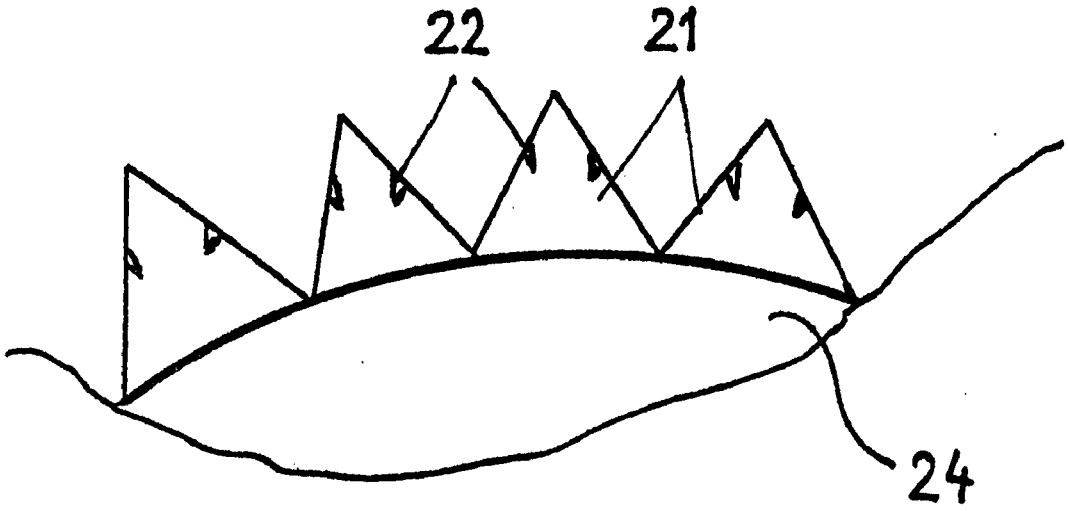
FIG. 8 shows (not true to scale) a top view onto a section of a disk from a disk roller.

As already mentioned, toothed disk rollers may be used in the compacting means instead of trimmed rollers. FIG. 8 shows a section from the rim portion of an individual toothed disk 24 in a view not true to scale. In this figure the radius of curvature of the disk and the height of the teeth are particularly shown in a distorted way to more clearly show the features according to the invention. It can be recognized that the teeth 21 close to their tips are provided with notches 22 on their flanks extending in the circumferential direction. Fibers may catch in these notches 22, which supports the pressing-in of fibers into the compacted fiber fleece.

While the principles of the invention have been shown and described in connection with specific embodiments, it is to be understood that such embodiments are by way of example and are not limiting.

What is claimed is:

1. In an apparatus for feeding a fiber fleece web to a needling zone of a needling machine, the apparatus including (a) a pre-compressor having a lower endless moving belt and an upper endless moving pre-compression belt arranged above the lower belt and forming therewith a gap which narrows in the direction of movement of a fiber fleece web to be fed therebetween, and (b) a supply roller pair arranged in front of the needling zone of the needling machine, the supply roller pair including upper and lower supply rollers forming a gap therebetween and being provided with non-rotating guide fingers each of which bridges over a gusset gap between the supply rollers and the needling machine, the improvement comprising a compacting device between the pre-compressor and the supply roller pair, the compacting device including at least two compacting rollers forming a compacting gap through which the fleece web is fed, at least one of the compacting rollers being provided on its periphery with all-steel armaments or being formed as a disk roller.

2. The apparatus of claim 1, wherein the compacting device comprises at least one compacting roller triple including (a) two lower compacting rollers arranged closely spaced and adjacent to one another, the lower compacting rollers being provided on their peripheries with all-steel armaments or being formed as disk rollers, and (b) an upper compacting roller bridging over a gusset formed between the lower compacting rollers, the upper compacting roller tightly opposing the two lower compacting rollers.

3. The apparatus of claim 2 comprising at least two of such compacting roller triples between the pre-compressor and the supply roller pair, the roller triples being on the same level.

4. The apparatus of claim 1 wherein the disk roller includes a plurality of disks with peripheral teeth having notches with openings directed toward the tooth distal ends.

5. The apparatus of claim 1 wherein two of the compacting rollers forming the compacting gap are toothed disk rollers, the toothed disks of each such compacting roller being axially arranged with spaces therebetween such that the toothed disks of each of the compacting rollers are aligned toward the spaces between the toothed disks of the other compacting roller.

6. The apparatus of claim 1 wherein the compacting rollers are adjustably supported such that the distance between the opposed rollers is variable.

7. The apparatus of claim 1 further comprising a filling roller positioned in a gusset formed between the compacting roller on the discharge side of the compacting device and one of the supply rollers of the needling machine, the filling roller being of smaller diameter than the compacting rollers and substantially filling the entire gusset.

8. The apparatus of claim 1 wherein the supply rollers are provided on their peripheries with all-steel armaments and have a rough surface.

9. The apparatus of claim 8 wherein the supply rollers are driven at higher circumferential speeds than the compacting rollers.

10. The apparatus of claim 9 wherein the at least two compacting rollers form a set of compacting rollers and wherein:

there are adjacent sets of compacting rollers including a first set and a successive set; and the compacting rollers of the successive set are driven at greater circumferential speeds than the compacting rollers of the first set.

11. The apparatus of claim 10 wherein:

the compacting device includes at least two compacting roller triples between the pre-compressor and the supply roller pair, each compacting roller triple including (a) two lower compacting rollers arranged closely spaced and adjacent to one another and (b) an upper compacting roller bridging over a gusset formed between the lower compacting rollers; and an intervening roller is between the roller triples on a level above the lower compacting rollers of the roller triples, the intervening roller having a smooth surface and being positioned to press the fiber fleece web onto the lower compacting rollers of the roller triples.

12. The apparatus of claim 1 wherein the at least two compacting rollers form a set of compacting rollers and wherein:

there are adjacent sets of compacting rollers including a first set and a successive set; and the compacting rollers of the successive set are driven at greater circumferential speeds than the compacting rollers of the first set.

13. The apparatus of claim 12 wherein:

the compacting device includes at least two compacting roller triples between the pre-compressor and the supply roller pair, each compacting roller triple including (a) two lower compacting rollers arranged closely spaced and adjacent to one another and (b) an upper compacting roller bridging over a gusset formed between the lower compacting rollers; and an intervening roller is between the roller triples on a level above the lower compacting rollers of the roller triples, the intervening roller having a smooth surface and being positioned to press the fiber fleece web onto the lower compacting rollers of the roller triples.

14. In an apparatus for feeding a fiber fleece web to a needling zone of a needling machine, the apparatus including (a) a pre-compressor having a lower endless moving belt and an upper endless moving pre-compression belt arranged above the lower belt and forming therewith a gap which narrows in the direction of movement of a fiber fleece web to be fed therebetween, and (b) a supply roller pair arranged in front of the needling zone of the needling machine, the supply roller pair including upper and lower supply rollers forming a gap therebetween and being provided with non-rotating guide fingers each of which bridges over a gusset gap between the supply rollers and the needling machine, the improvement comprising a compacting device between the pre-compressor and the supply roller pair, the compacting device including (1) a compacting roller which is provided on its periphery with all-steel armaments or is formed as a disk roller and (2) a trough member opposing the compacting roller and forming therewith a compacting gap through which the fleece web is fed, the compacting gap having a discharge end facing the supply roller pair and being progressively more constricting in the direction of rotation of the compacting roller, thereby to compact the fiber fleece web.

15. The apparatus of claim 14 wherein the compacting roller and trough member form a compacting set and wherein:

there are adjacent compacting sets, including a first compacting set and a successive set;

the compacting roller of the successive set is driven at greater circumferential speed than the compacting roller of the first set; and the compacting sets together form a drawing zone for the fiber fleece web.

16. The apparatus of claim 15 wherein the distance between each of the trough members and its associated compacting roller is adjustable.

17. The apparatus of claim 15 wherein each of the trough members is adjustable about the axis of rotation of its associated compacting roller.

18. The apparatus of claim 15 wherein the trough members of the first and successive compacting sets are positioned with one trough member above its associated compacting roller and the other trough member below its associated compacting roller.

19. The apparatus of claim 16 wherein the distance between each of the trough members and its associated compacting roller is adjustable.

20. The apparatus of claim 16 wherein each of the trough members is adjustable about the axis of rotation of its associated compacting roller.

* * * * *

UNITED STATES PATENT AND TRADEMARK OFFICE

CERTIFICATE OF CORRECTION

PATENT NO. : 6,634,069 B2
DATED : October 21, 2003
INVENTOR(S) : Johann Philipp Dilo et al.

It is certified that error appears in the above-identified patent and that said Letters Patent is hereby corrected as shown below:

Column 1,
Lines 65-67, delete "it cannot recover so easily, as the fleece that was compressed without its fiber structure having been changed be re-orientation of the fibers" and insert -- it cannot recover as easily as fleece which is compressed without the re-orientation of its fibers and change in fiber structure --.

Column 6,
Line 34, delete "FIG. 13" and insert -- FIG. 1-3 --.

Column 10,
Lines 41 and 44, "of claim 16" and insert -- of claim 18 --.

Signed and Sealed this

Twenty-third Day of March, 2004

JON W. DUDAS
*Acting Director of the United States Patent and Trademark Office*